US008136811B1

(12) United States Patent
Kuo et al.

(10) Patent No.: US 8,136,811 B1
(45) Date of Patent: Mar. 20, 2012

(54) AUTOMATIC DOCUMENT FEEDER

(75) Inventors: Ping-Hung Kuo, Taipei (TW); Wei-Hsun Hsu, Taipei (TW); Szu-Chieh Wu, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 13/015,249

(22) Filed: Jan. 27, 2011

(30) Foreign Application Priority Data

Dec. 10, 2010 (TW) ..... 99143194 A

(51) Int. Cl.
*B65H 7/02* (2006.01)

(52) U.S. Cl. ..... 271/227; 271/228

(58) Field of Classification Search ..... 271/227, 271/228
See application file for complete search history.

(56) References Cited

U.S. PATENT DOCUMENTS

2006/0261540 A1* 11/2006 Loiselle et al. ..... 271/228
2011/0115154 A1* 5/2011 Fujiwara et al. ..... 271/228

FOREIGN PATENT DOCUMENTS

JP 403205248 A * 9/1991

* cited by examiner

*Primary Examiner* — Daviid H Bollinger
(74) *Attorney, Agent, or Firm* — Kirton McConkie; Evan R. Witt

(57) ABSTRACT

An automatic document feeder includes a paper guide casing, a photo interrupter, a first sensing unit, a second sensing unit and a controller. During the paper is transported through the paper guide casing, the first sensing unit and the second sensing unit are respectively triggered by two ends of the paper. Consequently, the photo interrupter is conducted for a first duration T1 or a second duration T2. According to the first duration T1 or the second duration T2, a skew angle of the paper is calculated by the controller.

10 Claims, 8 Drawing Sheets

AUTOMATIC DOCUMENT FEEDER

FIELD OF THE INVENTION

The present invention relates to an automatic document feeder, and more particularly to an automatic document feeder with a paper skew detection mechanism.

BACKGROUND OF THE INVENTION

An office machine such as a multifunction peripheral and an image scanning apparatus becomes an essential electronic device in the office. Generally, for continuously feeding a stack of documents to increase the scanning speed, the multifunction peripheral or the image scanning apparatus is usually equipped with an automatic document feeder.

FIG. 1A is a schematic perspective view illustrating a conventional automatic document feeder, which is disclosed in for example Japanese Patent Publication No. 2008-201513. As shown in FIG. 1A, the automatic document feeder 1 comprises a pick-up roller assembly 11, a paper detecting mechanism 12 and a feed roller assembly 13. The paper detecting mechanism 12 comprises a first sensing arm 12*a*, a second sensing arm 12*b*, a transverse rod 12*c* and a sensing switch 12*d*. The sensing switch 12*d* is connected with the transverse rod 12*c* through a connecting lever 12*e*.

Please refer to FIG. 1B, which illustrates the condition when the second sensing arm 12*b* is triggered by a skewed paper. During a scanning process, the paper 14 to be scanned is transported through the paper detecting mechanism 12 by the pick-up roller assembly 11. Then, the paper 14 is clamped by the feed roller assembly 13, and the paper is fed into the internal portion of the automatic document feeder 1. As shown in FIG. 1B, during the paper 14 is fed into the internal portion of the automatic document feeder 1, the paper 14 is skewed. After the front edge 14*a* of the paper 14 is transported through the pick-up roller assembly 11, a first end 14*b* of the paper 14 is firstly transported through the second sensing arm 12*b*, so that a second terminal 12*cb* of the transverse rod 12*c* is pressed by the second sensing arm 12*b*. Meanwhile, the sensing switch 12*d* is not triggered, the feed roller assembly 13 is not enabled, and the paper 14 is continuously transported by the pick-up roller assembly 11.

Please refer to FIG. 1C, which illustrates the condition when the first sensing arm 12*a* and the second sensing arm 12*b* are triggered by the skewed paper 14. As the skewed paper 14 is continuously advanced, a second end 14*c* of the paper is transported through the first sensing arm 12*a*. Consequently, a first terminal 12*ca* of the transverse rod 12*c* is pressed by the first sensing arm 12*a*, thereby triggering the sensing switch 12*d*. After the sensing switch 12*d* is triggered, the feed roller assembly 13 is still not enabled. In this situation, a skew correcting operation can be performed before the skewed paper 14 is fed into the internal portion of the automatic document feeder 1. During the skew correcting operation is performed, the paper 14 is continuously transported by the pick-up roller assembly 11. As the paper 14 is moved forwardly, the first end 14*b* of the paper 14 will be contacted with the feed roller assembly 13 and stopped by the feed roller assembly 13 from being continuously advanced. Then, the second end 14*c* of the paper 14 is continuously moved toward the feed roller assembly 13, so that the front edge 14*a* of the paper 14 is gradually parallel with the feed roller assembly 13. Meanwhile, the purpose of correcting the skew of the paper is achieved. After the paper 14 is moved through a constant distance, the feed roller assembly 13 is enabled to feed the paper 14 into the internal portion of the automatic document feeder 1 in order to perform the scanning operation.

From the above discussion, it is noted that the automatic document feeder 1 uses the paper detecting mechanism 12 to correct the paper skew when the paper is transported through the paper detecting mechanism 12. After the paper skew is corrected, the sequent scanning operation will be operated more smoothly.

As previously described, by realizing whether the sensing switch 12*d* is triggered or not, the paper detecting mechanism 12 may determine the timing of enabling the feed roller assembly 13 and the pick-up roller assembly 11 so as to perform the skew correcting operation. The conventional automatic document feeder 1, however, still has some drawbacks. For example, only after the sensing switch 12*d* is triggered, the conventional automatic document feeder 1 can judge that two ends of the paper 14 are both transported through the paper detecting mechanism 12. However, the skew angle of the paper 14 fails to be accurately realized when the paper 14 is skewed. If the skew angle of the paper 14 is too large, the distance difference of the first end 14*b* and the second end 14*c* of the paper 14 with respect to the feed roller assembly 13 is greater than the constant distance. Under this circumstance, even if the paper 14 is fed into the internal portion of the automatic document feeder 1 after the skew correcting operation, the scanned image is possibly distorted or the paper 14 is possibly jammed in the feeding channel. On the other hand, if the skew angle of the paper 14 is too small or even if the paper 14 is not skewed, the skew correcting operation of the paper 14 is still performed by the disabled feed roller assembly 13 during the paper 14 is transported through the paper detecting mechanism 12; and then the paper 14 is fed into internal portion of the automatic document feeder 1 by the feed roller assembly 13. Under this circumstance, the operating time is prolonged, and the overall working efficiency is impaired.

Therefore, there is a need of providing an improved automatic document feeder so as to obviate the drawbacks encountered from the prior art.

SUMMARY OF THE INVENTION

The present invention provides an automatic document feeder having a mechanism of detecting a skew angle of a paper.

In accordance with an aspect of the present invention, there is provided an automatic document feeder for feeding a paper. The automatic document feeder includes a paper guide casing, a photo interrupter, a first sensing unit, a second sensing unit and a controller. The paper guide casing is used for guiding the paper to be fed into an internal portion of the automatic document feeder. The photo interrupter is disposed within the paper guide casing, and includes a transmitting terminal and a receiving terminal. The first sensing unit is disposed within the paper guide casing, and includes a first touching part, a first transverse rod and a first sensing part. The first touching part is protruded outside a first end of the paper guide casing. The first sensing part is permitted to be freely swung between the transmitting terminal and the receiving terminal. The first sensing part has a first slot. The second sensing unit is disposed within the paper guide casing, and includes a second touching part, a second transverse rod and a second sensing part. The second touching part is protruded outside a second end of the paper guide casing. The second sensing part is permitted to be freely swung between the transmitting terminal and the receiving terminal. The second sensing part has a second slot. The controller is used for calculating a skew angle of the paper. During the paper is fed, the first touching part transverse rod are rotated to swing the first sensing part and the second sensing part between the transmitting terminal and the receiving terminal. As the first sensing part and the second sensing part are swung to completely overlap the first slot with the second slot, the photo interrupter is conducted for a first duration T1. Whereas, as the first sensing part and the second sensing part are swung to partially overlap the first slot with the second slot, the photo interrupter is conducted for a second duration T2. If the photo interrupter is conducted for the first duration T1, the controller judges that the paper is not skewed. Whereas, if the photo interrupter is conducted for the second duration T2, the controller calculates the skew angle of the paper.

In an embodiment, after the skew angle of the paper is obtained, the controller judges whether the skew angle is within a correctable range. If the skew angle of the paper exceeds the correctable range, the automatic document feeder is controlled by the controller to stop feeding the paper and emit an erroneous warning message. If the skew angle of the paper is within the correctable range, the automatic document feeder is controlled by the controller to perform a skew correcting operation. Whereas, if the skew angle of the paper is within the correctable range and close to 0° or equal to 0°, the controller judges that the skew correcting operation is not needed and controls the automatic document feeder to continuously feed the paper.

In an embodiment, the automatic document feeder further includes a pick-up module and a separation pad. The pick-up module is disposed over the paper guide casing for transporting the paper through the paper guide casing. The separation pad is disposed over the paper guide casing and under the pick-up module for separating the paper.

In an embodiment, the first touching part and the second touching part are arranged downstream of the separation pad.

In an embodiment, the first sensing part and the second sensing part are parallel with each other.

In an embodiment, the first sensing part and the second sensing part are sectorial slices, wherein the first slot and the second slot are arc-shaped and formed in peripheries of the sectorial slices.

In an embodiment, the first touching part and the first sensing part are respectively arranged at two opposite ends of the first transverse rod and both perpendicular to the first transverse rod. The second touching part and the second sensing part are respectively arranged at two opposite ends of the second transverse rod and both perpendicular to the second transverse rod. In addition, the first transverse rod and the second transverse rod are arranged along the same horizontal line.

In an embodiment, the automatic document feeder further includes a printed circuit board assembly. The first duration T1 or the second duration T2 of conducting the photo interrupter is transmitted to the controller through the printed circuit board assembly.

In an embodiment, the first duration T1 is longer than the second duration T2.

In an embodiment, the skew angle of the paper is calculated by formulae: $\Delta T = T1 - T2$, $\Delta L = V \times \Delta T$, and $\theta = \arctan(\Delta L/S)$, wherein V is a moving speed of the paper, ΔL is a displacement difference between the first end and the second end of the paper, S is a total length of the first transverse rod and the second transverse rod, and θ is the skew angle of the paper.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides an automatic document feeder. The automatic document feeder may be applied to a multifunction peripheral or a sheetfed scanner.

Figure 1A:
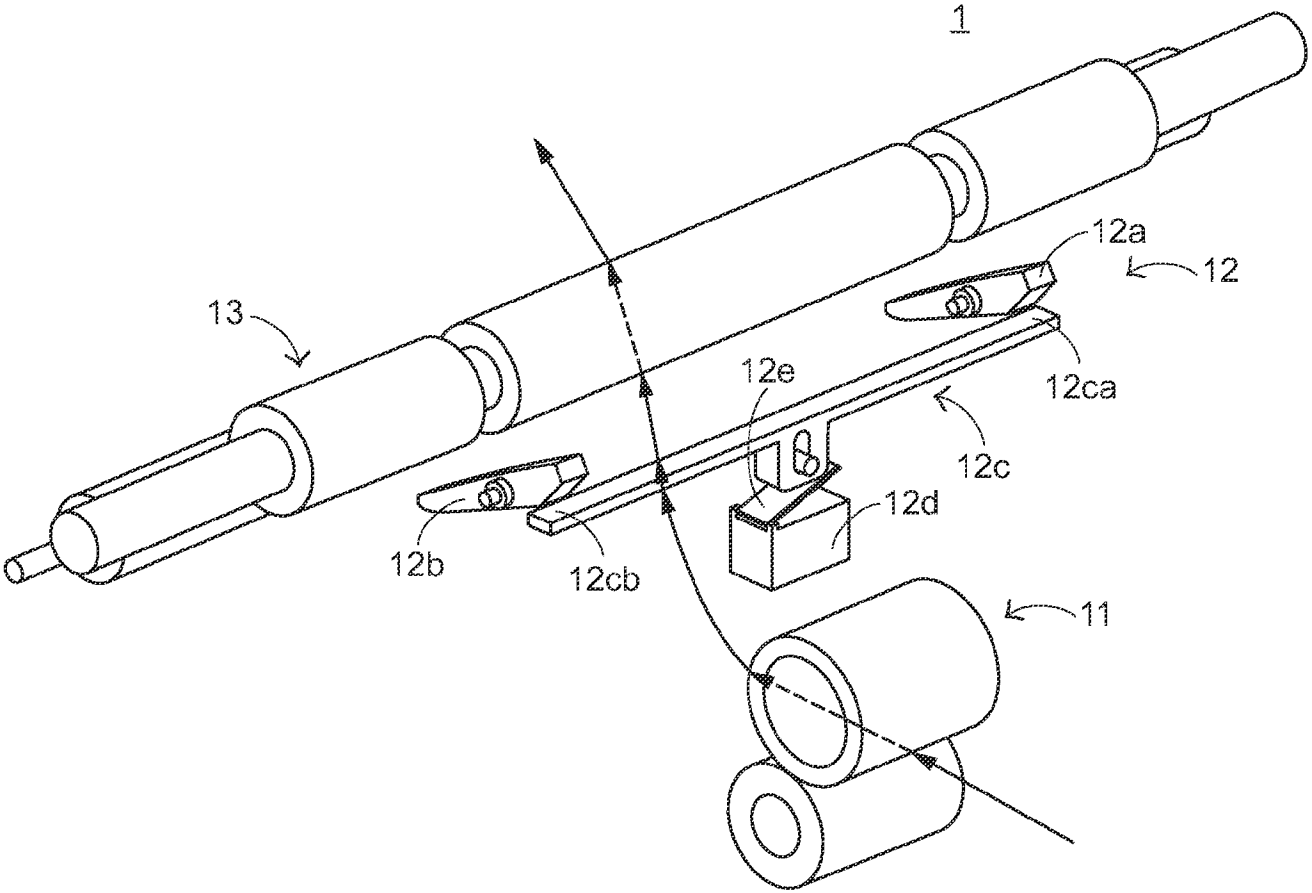
FIG. 1A PRIOR ART
FIG. 1A is a schematic perspective view illustrating a conventional automatic document feeder.
Figure 1B:
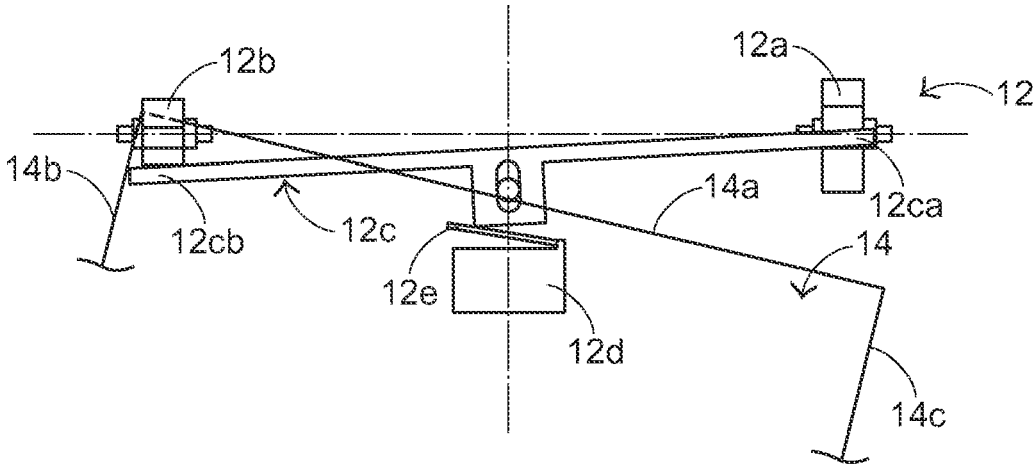
FIG.1B PRIOR ART
FIG. 1B is a schematic view illustrating the condition when the second sensing arm of the automatic document feeder of FIG. 1A is triggered by a skewed paper.
Figure 1C:
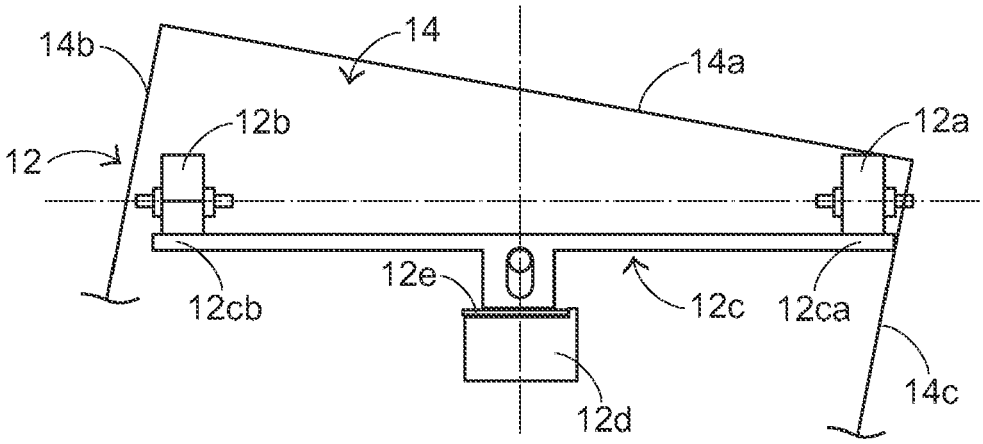
FIG.1C PRIOR ART
FIG. 1C is a schematic view illustrating the condition when the first sensing arm and the second sensing arm of the automatic document feeder of FIG. 1A is triggered by the skewed paper.
Figure 2A:
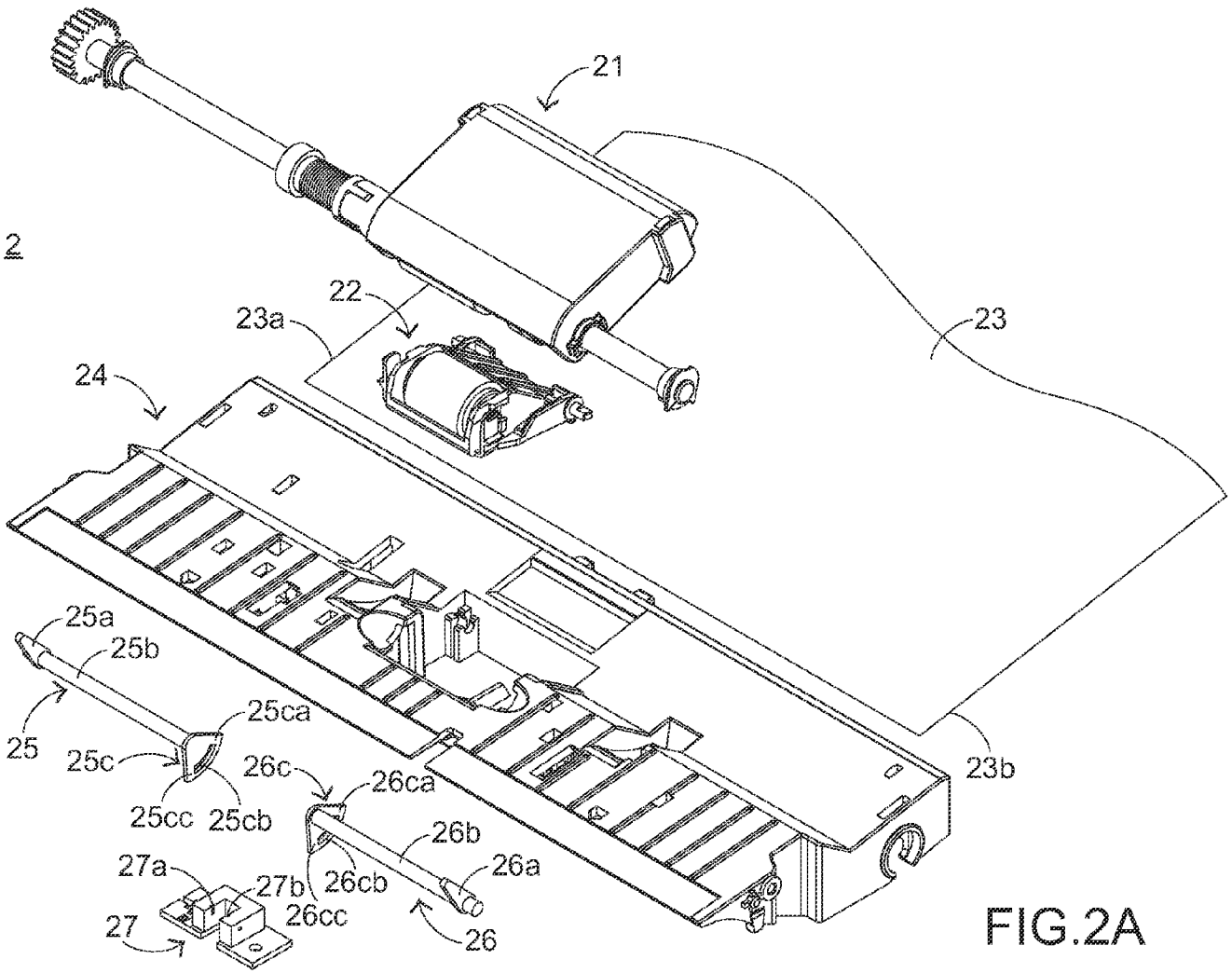
FIG. 2A is a schematic exploded view illustrating an automatic document feeder according to an embodiment of the present invention.

FIG. 2A is a schematic exploded view illustrating an automatic document feeder according to an embodiment of the present invention. The automatic document feeder 2 is used for feeding a paper 23. The automatic document feeder 2 comprises a pick-up module 21, a separation pad 22, a paper guide casing 24, a first sensing unit 25, a second sensing unit 26 and a photo interrupter 27. The first sensing unit 25 comprises a first touching part 25*a*, a first transverse rod 25*b* and a first sensing part 25*c*. The second sensing unit 26 comprises a second touching part 26*a*, a second transverse rod 26*b* and a second sensing part 26*c*. The photo interrupter 27 comprises a transmitting terminal 27*a* and a receiving terminal 27*b*.

The separation pad 22 is disposed over the paper guide casing 24. The pick-up module 21 is disposed over the separation pad 22. The first sensing unit 25, the second sensing unit 26 and the photo interrupter 27 are disposed within the paper guide casing 24. The transmitting terminal 27*a* and the receiving terminal 27*b* of the photo interrupter 27 face to each other. In addition, the transmitting terminal 27*a* and the receiving terminal 27*b* are separated from each other by a certain distance.

Figure 2B:
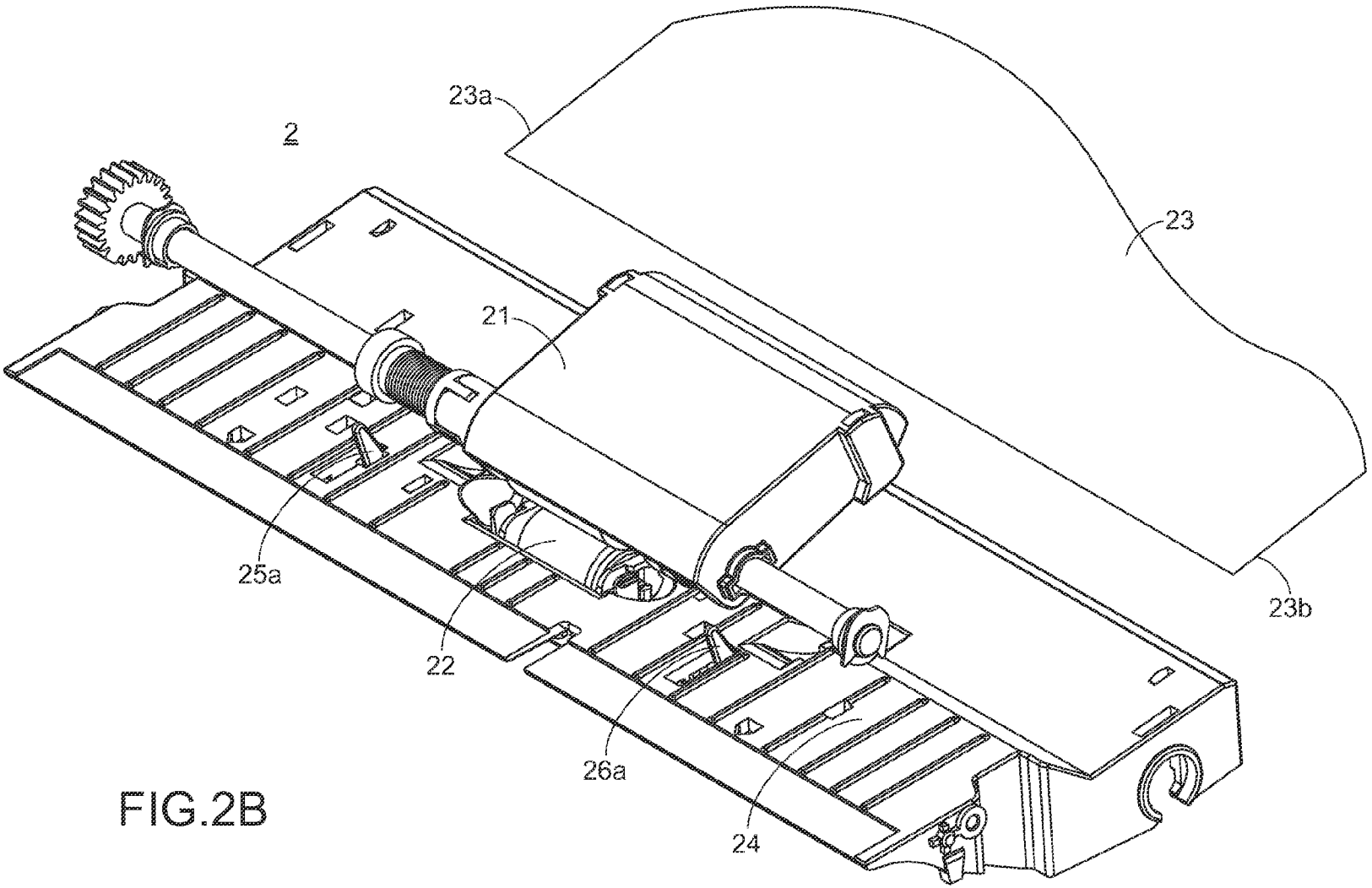
FIG. 2B is a schematic perspective view illustrating the automatic document feeder of FIG. 2A.

Please refer to FIG. 2B. FIG. 2B is a schematic perspective view illustrating the automatic document feeder of FIG. 2A. The first touching part 25*a* of the first sensing unit 25 is protruded outside a first end of the paper guide casing 24. The second touching part 26*a* of the second sensing unit 26 is protruded outside a second end of the paper guide casing 24. Both of the first touching part 25*a* and the second touching part 26*a* are arranged downstream of the separation pad 22. After the paper 23 is transported through the region between the pick-up module 21 and the separation pad 22, the paper 23 is transported through the first touching part 25*a* and the second touching part 26*a* that are protruded outside the paper guide casing 24, and then fed into the internal portion of the automatic document feeder 2.

Figure 2C:
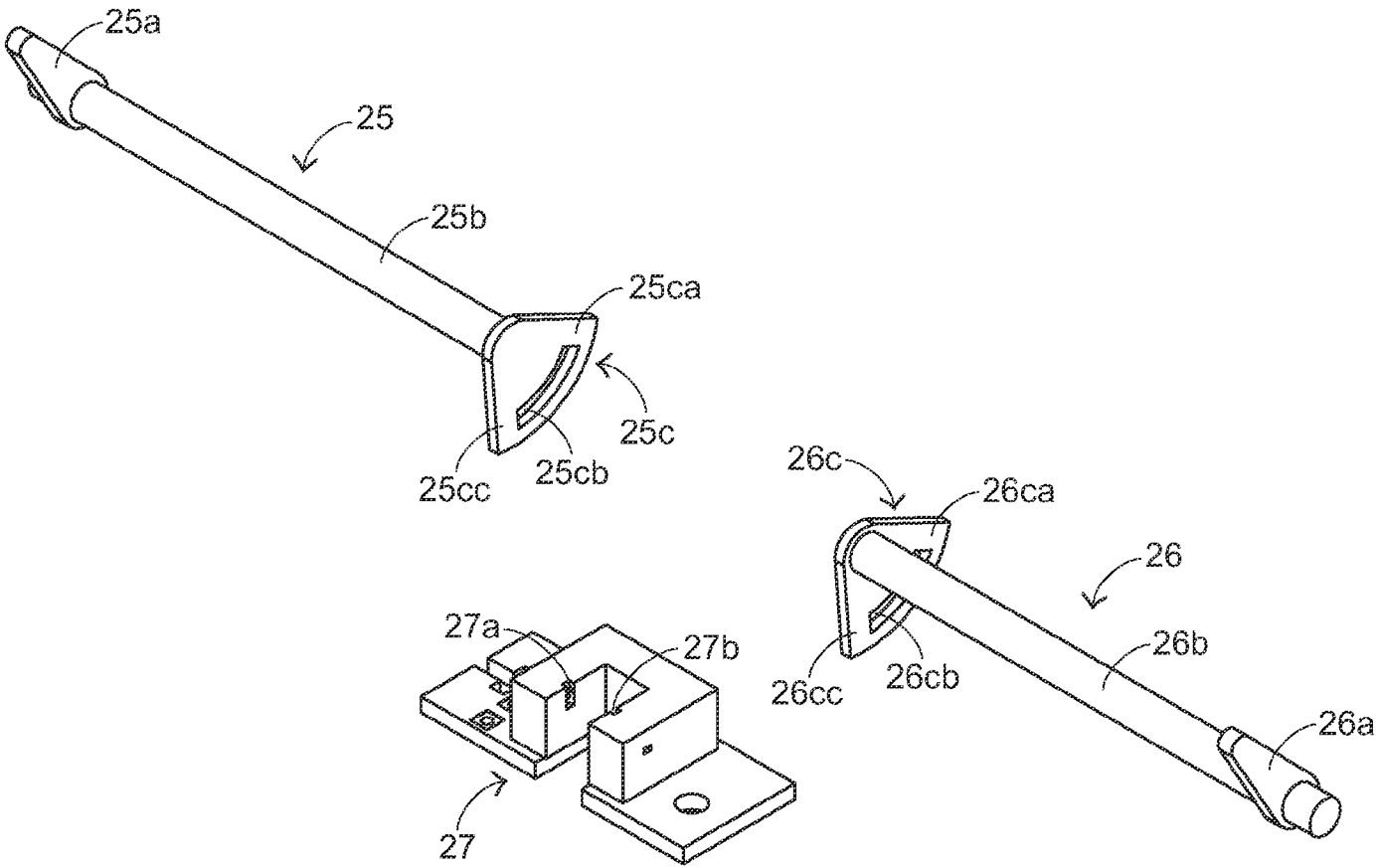
FIG. 2C is a schematic exploded view illustrating the first sensing unit, the second sensing unit and the photo interrupter of the automatic document feeder of FIG. 2A.

Please refer to FIG. 2C. In the exploded view of FIG. 2C, only the first sensing unit 25, the second sensing unit 26 and the photo interrupter 27 of the automatic document feeder 2 are shown. The first touching part 25*a* and the first sensing part 25*c* of the first sensing unit 25 are both perpendicular to the first transverse rod 25*b*. The first sensing part 25*c* is arranged between the transmitting terminal 27*a* and the receiving terminal 27*b* of the photo interrupter 27. In addition, the first sensing part 25*c* can be freely swung between the transmitting terminal 27*a* and the receiving terminal 27*b*. In this embodiment, the first sensing part 25*c* is a sectorial slice with an arc-shaped first slot 25*cb*, a first interrupting part 25*ca* and a second interrupting part 25*cc*. The first slot 25*cb* is formed in a periphery of the first sensing part 25*c*. The first interrupting part 25*ca* and the second interrupting part 25*cc* are respectively arranged at two opposite sides of the first slot 25*cb*. The second transverse rod 26*b* of the second sensing unit 26 and the first transverse rod 25*b* of the first sensing unit 25 are arranged along the same horizontal line. The second touching part 26*a* and the second sensing part 26*c* of the second sensing unit 26 are both perpendicular to the second transverse rod 26*b*. The second sensing part 26*c* is also arranged between the transmitting terminal 27*a* and the receiving terminal 27*b* of the photo interrupter 27. In addition, the second sensing part 26*c* can be freely swung between the transmitting terminal 27*a* and the receiving terminal 27*b*. In this embodiment, the second sensing part 26*c* is a sectorial slice with an arc-shaped second slot 26*cb*, a first interrupting part 26*ca* and a second interrupting part 26*cc*. The second slot 26*cb* is formed in a periphery of the second sensing part 26*c*. The first interrupting part 26*ca* and the second interrupting part 26*cc* are respectively arranged at two opposite sides of the second slot 26*cb*.

Hereinafter, the operations of the automatic document feeder 2 will be illustrated with reference to FIGS. 2A, 2B and 2C. During a scanning process, the paper 23 to be scanned is transported by the pick-up module 21, and then the paper 23 is separated from the underlying papers (not shown) via the separation pad 22. Then, the paper 23 is transported through the first sensing unit 25 and the second sensing unit 26 overlying the paper guide casing 24. After the rear edge of the paper 23 is transported through the first sensing unit 25 and the second sensing unit 26, the next paper is transported by the pick-up module 21. The above steps are repeatedly done until the scanning task is completed.

Figure 3A:
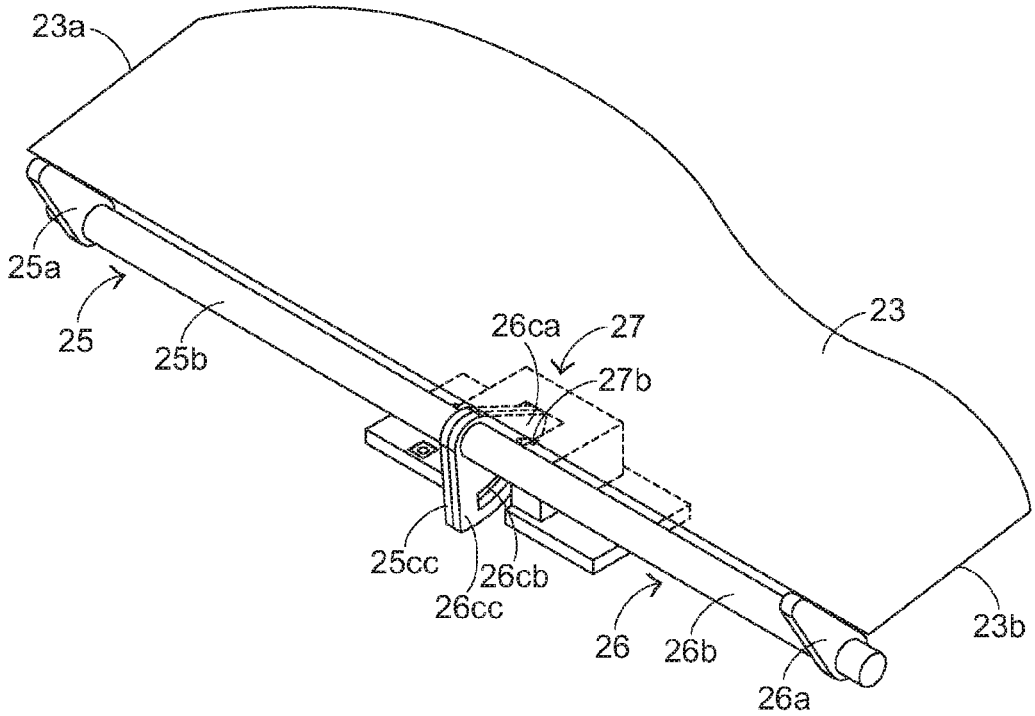
FIG. 3A schematically illustrates a non-skewed paper fed by the automatic document feeder of the present invention.
Figure 3B:
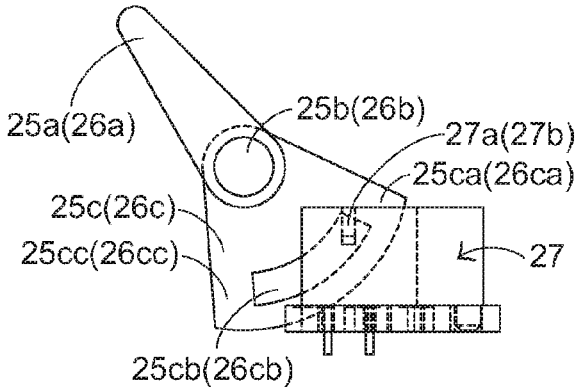
FIG. 3B is a schematic cross-sectional view illustrating the relationship between the first sensing unit, the second sensing unit and the photo interrupter during the non-skewed paper is fed by the automatic document feeder.

At the moment when the paper 23 is transported through the first sensing unit 25 and the second sensing unit 26, the skew angle of the paper 23 will be detected according to the duration of conducting the photo interrupter 27. Please refer to FIGS. 3A and 3B. FIG. 3A schematically illustrates a non-skewed paper 23 fed by the automatic document feeder 2 of the present invention. FIG. 3B is a schematic cross-sectional view illustrating the relationship between the first sensing unit 25, the second sensing unit 26 and the photo interrupter 27 during the non-skewed paper 23 is fed by the automatic document feeder 2. Before the paper 23 is fed into the internal portion of the automatic document feeder 2, the light path of the photo interrupter 27 is completely interrupted by the first interrupting part 25*ca* of the first sensing part 25*c* and the first interrupting part 26*ca* of the second sensing part 26*c*. In a case that the paper 23 fed by the automatic document feeder 2 is not skewed, the first touching part 25*a* and the second touching part 26*a* are simultaneously pushed by a first end 23*a* and a second end 23*b* of the paper 23, respectively. Correspondingly, the first transverse rod 25*b* and the second transverse rod 26*b* are rotated, so that the first sensing part 25*c* and the second sensing part 26*c* are swung within the region between the transmitting terminal 27*a* and the receiving terminal 27*b* of the photo interrupter 27. Since the first sensing part 25*c* and the second sensing part 26*c* are simultaneously swung, the light emitted from the transmitting terminal 27*a* of the photo interrupter 27 simultaneously passes through the first slot 25*cb* and the second slot 26*cb*.

Figure 3C:
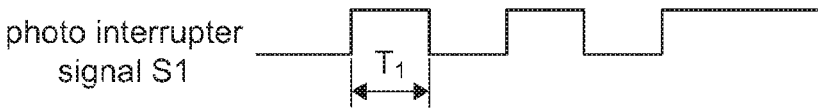
FIG. 3C is a schematic timing waveform diagram illustrating a photo interrupter signal generated in response to the non-skewed paper.

Please refer to FIG. 3C, which is a schematic timing waveform diagram illustrating a photo interrupter signal S1 generated in response to a non-skewed paper. As the paper 23 is continuously advanced, the light emitted from the transmitting terminal 27*a* is continuously received by the receiving terminal 27*b* of the photo interrupter 27. Until the first sensing part 25*c* and the second sensing part 26*c* are simultaneously swung to the uppermost positions, the light emitted from the transmitting terminal 27*a* is completely blocked by the second interrupting parts 25*cc* and 26*cc*. In other words, the photo interrupter 27 is conducted for a first duration T1.

Figure 5:
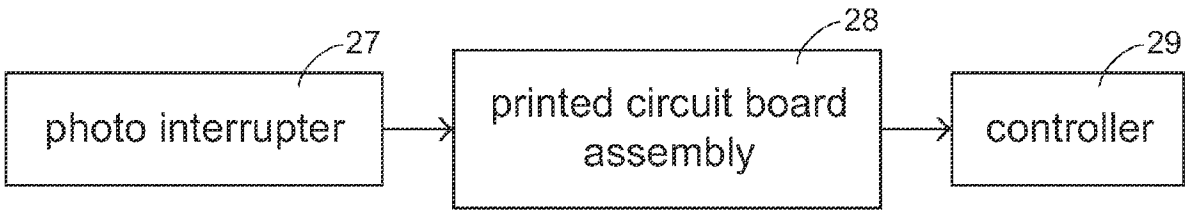
FIG. 5 is a schematic block diagram, illustrating a path of transmitting a photo interrupter signal in the automatic document feeder according to an embodiment of the present invention.

The photo interrupter signal S1 indicating the conduction of the photo interrupter 27 for the first duration T1 will be transmitted to a controller 29 through a printed circuit board assembly (PCBA) 28 of the automatic document feeder 2 (see FIG. 5). According to the photo interrupter signal S1, the controller 29 judges that the paper 23 is not skewed. In this situation, the paper 23 is continuously transported by the pick-up module 21.

Figure 4A:
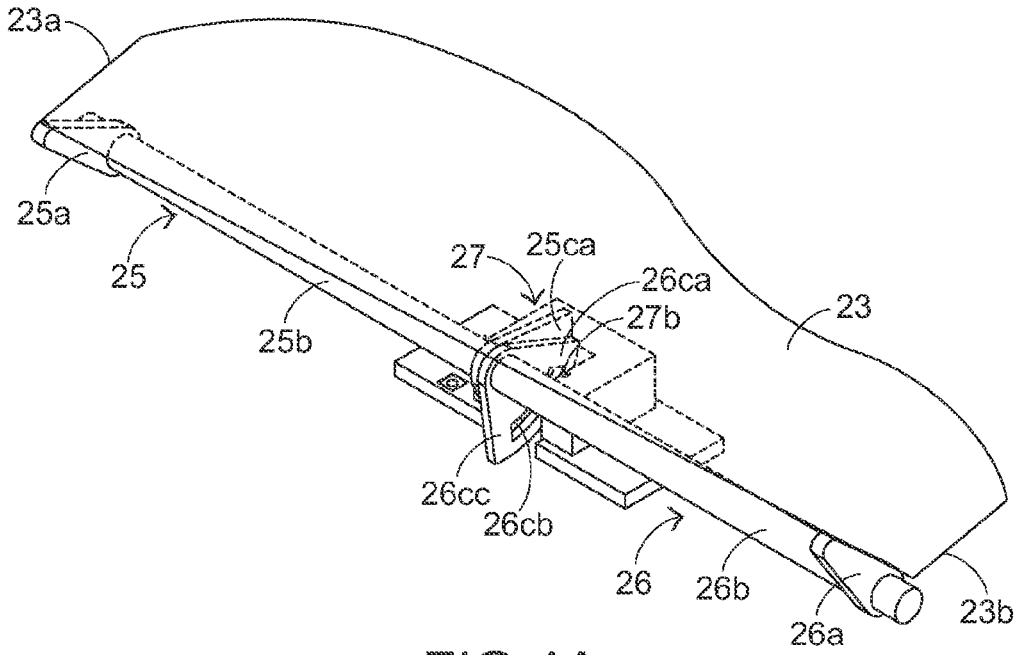
FIG. 4A schematically illustrates a skewed paper fed by the automatic document feeder of the present invention.
Figure 4B:
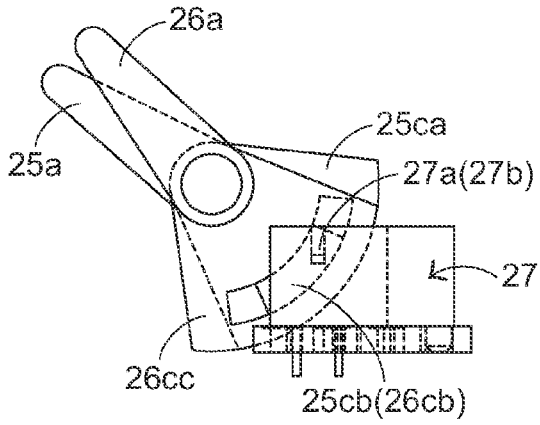
FIG. 4B is a schematic cross-sectional view illustrating the relationship between the first sensing unit, the second sensing unit and the photo interrupter during the skewed paper is fed by the automatic document feeder.

Please refer to FIGS. 4A and 4B. FIG. 4A schematically illustrates a skewed paper 23 fed by the automatic document feeder 2 of the present invention. FIG. 4B is a schematic cross-sectional view illustrating the relationship between the first sensing unit 25, the second sensing unit 26 and the photo interrupter 27 during the skewed paper 23 is fed by the automatic document feeder 2. In a case that the paper 23 fed by the automatic document feeder 2 is skewed, the first touching part 25*a* is firstly pushed by the first end 23*a* of the paper 23. Correspondingly, the first transverse rod 25*b* is rotated, so that the first sensing part 25*c* is swung within the region between the transmitting terminal 27*a* and the receiving terminal 27*b* of the photo interrupter 27. At the moment when the first sensing part 25*c* is swung, the second sensing part 26*c* has not been swung. In this situation, after the light emitted from the transmitting terminal 27*a* of the photo interrupter 27 passes through the first slot 25*cb*, the light is blocked by the first interrupting part 26*ca* of the second sensing part 26*c* and fails to be received by the receiving terminal 27*b*. Consequently, the photo interrupter 27 is in an interruption state. Before the first sensing part 25*c* is swung to the uppermost position, the second touching part 26*a* is pressed by the second end 23*b* of the paper 23, so that the second sensing part 26*c* is swung within the region between the transmitting terminal 27*a* and the receiving terminal 27*b* of the photo interrupter 27. In this situation, the light emitted from the transmitting terminal 27*a* of the photo interrupter 27 simultaneously passes through the first slot 25*cb* and the second slot 26*cb* to be received by the receiving terminal 27*b*. The light is continuously received by the receiving terminal 27*b* until the light emitted from the transmitting terminal 27*a* is completely blocked by the second interrupting part 25*cc* of the first sensing part 25*c*.

Figure 4C:
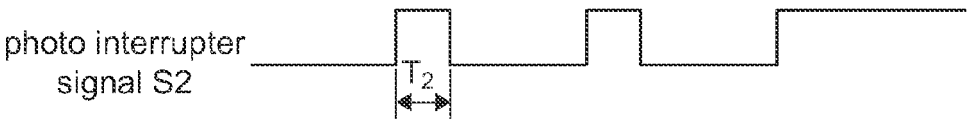
FIG. 4C is a schematic timing waveform diagram illustrating a photo interrupter signal generated in response to the skewed paper.

Please refer to FIG. 4C, which is a schematic timing waveform diagram illustrating a photo interrupter signal S2 generated in response to a skewed paper. As shown in FIG. 4C, the photo interrupter signal S2 indicates that photo interrupter 27 is conducted for a second duration T2. The second duration T2 is a time interval after the second sensing part 26*c* starts to be swung and before the first sensing part 25*c* is swung to the uppermost position. That is, the second duration T2 is shorter than the first duration T1.

The photo interrupter signal S2 indicating the conduction of the photo interrupter 27 for the second duration T2 will be transmitted to a controller 29 through the printed circuit board assembly (PCBA) 28 of the automatic document feeder 2 (see FIG. 5). According to the photo interrupter signal S2, the controller 29 judges that the paper 23 is skewed.

As a consequence, the controller 29 may calculate a skew angle of the paper 23 by the following formulae: $\Delta T = T1 - T2$, $\Delta L = V \times \Delta T$, and $\theta = \arctan(\Delta L/S)$. The uses of these formulae to acquire the skew angle of the paper 23 will be illustrated as follows. Firstly, a time difference $\Delta T$ between the first duration T1 and the second duration T2 is calculated. Then, a displacement difference $\Delta L$ between the first end 23*a* and the second end 23*b* of the paper 23 is calculated according to the time difference $\Delta T$ and a moving speed V of the fed paper 23. The moving speed of the fed paper 23 is controlled by the controller 29. Afterwards, the skew angle $\theta$ is obtained according to the displacement difference $\Delta L$ and the total length S of the first transverse rod 25*b* and the second transverse rod 26*b*.

After the skew angle $\theta$ of the paper 23 is obtained, the controller 29 will judge whether the skew angle $\theta$ is within a correctable range (e.g. $-5° \sim +5°$). If the skew angle $\theta$ of the paper 23 is within the correctable range, the paper 23 is continuously transported by the pick-up module 21, and a skew correcting operation is performed by a roller assembly (not shown), which is arranged downstream of the advancing path of the paper 23. If the skew angle $\theta$ of the paper 23 is too large and exceeds the correctable range, the controller 29 will control the pick-up module 21 to stop feeding the paper 23. At the same time, an erroneous warning message is emitted. Whereas, if the skew angle $\theta$ of the paper 23 is within the correctable range and close to 0° or if the paper 23 is not skewed, the controller 29 will control the pick-up module 21 to continuously transport the paper 23 without the need of performing the skew correcting operation. In this situation, the paper 23 is directly fed into the internal portion of the automatic document feeder 2, thereby enhancing the processing speed.

From the above description, the skew angle $\theta$ of the paper 23 is detected by the first sensing unit 25, the second sensing unit 26 and the photo interrupter 27 during the paper 23 is transported by the automatic document feeder 2. After the skew angle $\theta$ of the paper 23 is obtained, proper actions will be done. If the skew angle $\theta$ of the paper 23 exceeds the correctable range, the automatic document feeder 2 stops feeding the paper 23 in order to preventing damage of the paper 23 or the automatic document feeder 2. Moreover, if the skew angle $\theta$ of the paper 23 is within the correctable range and close to 0° or if the paper 23 is not skewed, the paper is continuously fed without the need of performing the skew correcting operation. As a consequence, the overall performance of the automatic document feeder 2 is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder for feeding a paper, said automatic document feeder comprising:

a paper guide casing for guiding said paper to be fed into an internal portion of said automatic document feeder;

a photo interrupter disposed within said paper guide casing, and comprising a transmitting terminal and a receiving terminal;

a first sensing unit disposed within said paper guide casing, and comprising a first touching part, a first transverse rod and a first sensing part, wherein said first touching part is protruded outside a first end of said paper guide casing, said first sensing part is permitted to be freely swung between said transmitting terminal and said receiving terminal, and said first sensing part has a first slot;

a second sensing unit disposed within said paper guide casing, and comprising a second touching part, a second transverse rod and a second sensing part, wherein said second touching part is protruded outside a second end of said paper guide casing, said second sensing part is permitted to be freely swung between said transmitting terminal and said receiving terminal, and said second sensing part has a second slot; and a controller for calculating a skew angle of said paper, wherein during said paper is fed, said first touching part and said second touching part are respectively pressed by a first end and a second end of said paper, so that said first transverse rod and said second transverse rod are rotated to swing said first sensing part and said second sensing part between said transmitting terminal and said receiving terminal, wherein as said first sensing part and said second sensing part are swung to completely overlap said first slot with said second slot, said photo interrupter is conducted for a first duration T1, wherein as said first sensing part and said second sensing part are swung to partially overlap said first slot with said second slot, said photo interrupter is conducted for a second duration T2, wherein if said photo interrupter is conducted for said first duration T1, said controller judges that said paper is not skewed, wherein if said photo interrupter is conducted for said second duration T2, said controller calculates said skew angle of said paper, and wherein after said skew angle of said paper is obtained, said controller judges whether said skew angle is within a correctable range, if said skew angle of said paper exceeds said correctable range, said automatic document feeder is controlled by said controller to stop feeding said paper and emits an erroneous warning message, and if said skew angle of said paper is within said correctable range, said automatic document feeder is controlled by said controller to perform a skew correcting operation.

2. The automatic document feeder according to claim 1 wherein if said skew angle of said paper is within said correctable range and close to 0° or equal to 0°, said controller judges that said skew correcting operation is not needed and controls said automatic document feeder to continuously feed said paper.

3. The automatic document feeder according to claim 1 further comprising:

a pick-up module disposed over said paper guide casing for transporting said paper through said paper guide casing; and a separation pad disposed over said paper guide casing and under said pick-up module for separating said paper.

4. The automatic document feeder according to claim 3 wherein said first touching part and said second touching part are arranged downstream of said separation pad.

5. The automatic document feeder according to claim 1 wherein said first sensing part and said second sensing part are parallel with each other.

6. The automatic document feeder according to claim 5 wherein said first sensing part and said second sensing part are sectorial slices, wherein said first slot and said second slot are arc-shaped and formed in peripheries of said sectorial slices.

7. The automatic document feeder according to claim 6 wherein said first touching part and said first sensing part are respectively arranged at two opposite ends of said first transverse rod and both perpendicular to said first transverse rod, wherein said second touching part and said second sensing part are respectively arranged at two opposite ends of said second transverse rod and both perpendicular to said second transverse rod, wherein said first transverse rod and said second transverse rod are arranged along the same horizontal line.

8. The automatic document feeder according to claim 1 further comprising a printed circuit board assembly, wherein said first duration T1 or said second duration T2 of conducting said photo interrupter is transmitted to said controller through said printed circuit board assembly.

9. The automatic document feeder according to claim 1 wherein said first duration T1 is longer than said second duration T2.

10. The automatic document feeder according to claim 9 wherein said skew angle of said paper is calculated by formulae: $\Delta T = T1 - T2$, $\Delta L = V \times \Delta T$, and $\theta = \arctan(\Delta L/S)$, wherein V is a moving speed of said paper, $\Delta L$ is a displacement difference between said first end and said second end of said paper, S is a total length of said first transverse rod and said second transverse rod, and $\theta$ is said skew angle of said paper.

* * * * *